US007486924B2

(12) United States Patent
Ito

(10) Patent No.: US 7,486,924 B2
(45) Date of Patent: Feb. 3, 2009

(54) IMAGE FORMING APPARATUS INCLUDING FIXER HAVING FIXING ROLLER AND METHODS OF MANUFACTURING THE SAME

(75) Inventor: Akiko Ito, Tokyo (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 11/826,049

(22) Filed: Jul. 12, 2007

(65) Prior Publication Data

US 2008/0013996 A1 Jan. 17, 2008

(30) Foreign Application Priority Data

Jul. 12, 2006 (JP) ..... 2006-191503

(51) Int. Cl.
*G03G 15/20* (2006.01)

(52) U.S. Cl. ..... 399/333; 399/330

(58) Field of Classification Search ..... 399/330, 399/333, 320

See application file for complete search history.

(56) References Cited

U.S. PATENT DOCUMENTS

| | | | | |
|---|---|---|---|---|
| 6,753,515 | B2 | 6/2004 | Miyahara et al. | |
| 6,946,629 | B2 | 9/2005 | Miyahara et al. | |
| 7,135,660 | B2 | 11/2006 | Miyahara et al. | |
| 2002/0031381 | A1 | 3/2002 | Miyahara et al. | |
| 2004/0184852 | A1 | 9/2004 | Takagi et al. | |
| 2004/0192528 | A1 | 9/2004 | Fukase et al. | |
| 2005/0008413 | A1 * | 1/2005 | Takagi et al. | 399/330 |
| 2005/0152721 | A1 * | 7/2005 | Kikuchi et al. | 399/333 |
| 2005/0242084 | A1 | 11/2005 | Miyahara et al. | |

FOREIGN PATENT DOCUMENTS

| | | |
|---|---|---|
| JP | 10-074007 | 3/1998 |
| JP | 2000-162912 | 6/2000 |
| JP | 2001-005315 | 1/2001 |
| JP | 2001-312168 | 11/2001 |
| JP | 2003-107936 | 4/2003 |
| JP | 2003-337494 | 11/2003 |
| JP | 2004-301291 | 10/2004 |
| JP | 2005-017762 | 1/2005 |
| JP | 2005-024725 | 1/2005 |
| JP | 2005-157303 | 6/2005 |

OTHER PUBLICATIONS

Office Action dated Nov. 9, 2007 for corresponding European Application No. 07252607.2.

* cited by examiner

*Primary Examiner*—David M Gray
*Assistant Examiner*—Kristofferson Service
(74) *Attorney, Agent, or Firm*—Harness, Dickey & Pierce, P.L.C.

(57) ABSTRACT

A fixing roller and method of manufacturing the same. The fixing roller includes a fixing sleeve configured to fuse and fix a toner image on a recording medium and a fixing assist roller configured to be inserted into the fixing sleeve. The fixing sleeve includes a first heating layer having a Curie point. The first heating layer is configured to be heated with a magnetic flux. The fixing assist roller includes an elastic insulating layer and a first low-resistivity layer. The elastic insulating layer is formed on an outer circumference of the fixing assist roller. The first low-resistivity layer is formed under the elastic insulating layer and has a volume resistivity not greater than $5.0\times10^{-8}$ Ωm. Convexities and concavities are alternately formed on an outer surface of the elastic insulating layer along a circumferential direction thereof.

15 Claims, 8 Drawing Sheets

IMAGE FORMING APPARATUS INCLUDING FIXER HAVING FIXING ROLLER AND METHODS OF MANUFACTURING THE SAME

PRIORITY STATEMENT

This patent specification is based on Japanese patent application, No. JP2006-191503 filed on Jul. 12, 2006 in the Japan Patent Office, the entire contents of which are incorporated by reference herein.

FIELD

Example embodiments generally relate to a fixer having a fixing roller and an image forming apparatus including the fixer, for example, a magnetic induction heating fixer having a fixing roller and an electronographic image forming apparatus including the fixer and methods of manufacturing the same.

DISCUSSION OF THE BACKGROUND

In general, an electronographic image forming apparatus such as a copying machine, a printer, and a facsimile machine may include an image forming mechanism for forming a toner image on a sheet of recording medium, and a fixer to fix the toner image on the recording medium.

A fixer generally includes a fixing sleeve having a heating layer, a heating source to heat the fixing sleeve, a pressurizer pressing the fixing sleeve and forming a fixing nip with the fixing sleeve. When the sheet passes through the fixing nip, the image is fixed with heat from the fixing sleeve and pressure from the pressurizer.

Electromagnetic induction heating fixers are widely used in image forming apparatuses to shorten the warm-up time of the fixer and to save energy. An example electromagnetic induction heating fixer include a fixing sleeve having a hollow center and a heating layer; a fixing assist roller provided inside the fixing sleeve; a coil unit facing the fixing sleeve (induction heating source); and a pressurizer pressing the fixing assist roller via the fixing sleeve (outer pressurizer). At a contact position of the fixing sleeve and the pressurizer, a fixing nip is formed. The fixing assist roller presses the fixing sleeve at the fixing nip from the inside. An elastic insulating layer is formed over a core metal in the fixing assist roller.

When a high-frequency alternating current is applied to the coil unit, an alternating magnetic field is formed around the coil unit. The magnetic field causes an eddy-current in the heating layer of the fixing sleeve. Where the eddy-current is generated, Joule heat is generated due to electric resistance of the heating layer. The Joule heat heats the whole fixing sleeve.

Another electromagnetic induction heating fixer includes a fixing roller having a heating layer, an elastic layer, and an insulating layer that are bonded together through a plasma process, etc. Because of the elastic layer or the elastic insulating layer, the fixing nip may be sufficient. Further, heat loss, which is the heat transferred from the fixing sleeve to the fixing assist roller, is reduced because of the insulating layer or the elastic insulating layer.

Another electromagnetic induction heating fixer includes a fixing roller, a pressing roller, and a flux generator located inside the fixing roller. The flux generator is located across the width of the fixing roller. The Curie point of the flux generator is lower at the region near both ends thereof than at a center region thereof in the width direction of the fixing roller. Heating efficiency is decreased when a temperature of the flux generator exceeds the Curie point. However, the fixing roller may be overheated before the heating efficiency of the flux generator is decreased.

One example pressing roller or insulating roller, which may be included in a fixer, includes an insulating layer having a concave-convex circumference surface to enhance insulating properties.

In general, an image forming apparatus is configured to handle various width size of recording media (e.g., sheets). Further, even for a same sized sheet, the image forming apparatus handles sheets having different widths when a longer side of the sheet is parallel to a sheet transfer direction and a shorter side of the sheet is parallel to the sheet transfer direction.

When a sheet having a smaller width passes a fixing nip formed between a fixing roller and a pressing roller, more heat is lost from a region of the fixing roller where the sheets pass (e.g., center region) than from other regions where sheets do not pass (e.g., regions near both ends). Therefore, a fixing temperature at the center region thereof becomes lower than the temperature at regions near both ends thereof. This phenomenon is clear when images on the sheets having smaller widths are continuously fixed.

Therefore, if the fixing temperature across the fixing roller in width direction thereof is controlled based on the temperature at the center region thereof, the temperature at regions near both ends thereof tends to excessively rise (overheated region). When a sheet having a larger width in a width direction thereof is fixed by the fixer in the above condition, a fixing failure (e.g., hot offset) occurs on a region of the sheet corresponding to the overheated region of the fixing roller. Further, the fixing roller may be thermally damaged if the temperature at the overheated region exceeds an upper temperature limit of the fixing roller.

However, if the fixing temperature across the fixing roller in width direction thereof is controlled based on the temperature at the overheated region (regions near both ends), the fixing temperature at the center region decreases. When a sheet is fixed by the fixer in the above condition, a fixing failure (e.g., cold offset) occurs on a region of the sheet corresponding to the region of the fixing roller having a lower temperature (center region).

Further, when a paper jam occurs in a sheet transport path in the image forming apparatus, the fixer may be accidentally stopped. In such a case, a region of the fixing roller facing a flux generator (induction heater) may be overheated in a short period before the flux generator is turned off. As a result, the fixing roller and a component of the flux generator may be thermally damaged.

SUMMARY

In view of foregoing, in an example, a fixing roller includes a fixing sleeve configured to fuse and fix a toner image on a recording medium and a fixing assist roller configured to be inserted into the fixing sleeve. The fixing sleeve includes a first heating layer having a Curie point. The first heating layer is configured to be heated with a magnetic flux. The fixing assist roller includes an elastic insulating layer and a first low-resistivity layer. The elastic insulating layer is formed on an outer circumference of the fixing assist roller. The first low-resistivity layer is formed under the elastic insulating layer and has a volume resistivity not greater than $5.0\times10^{-8}$ Ωm. Convexities and concavities are alternately formed on an outer surface of the elastic insulating layer along a circumferential direction thereof.

In another example, a fixer includes the fixing roller, a pressurizer configured to pressurize the fixing roller, and the magnetic flux generator configured to generate a magnetic flux.

In another example, an image forming apparatus includes an image forming mechanism configured to form a toner image, and the fixer.

In another example, a method of manufacturing a fixing roller may include providing a fixing sleeve configured to fuse and fix a toner image on a recording medium including a first heating layer having a Curie point, configured to be heated with a magnetic flux and inserting a fixing assist roller into the fixing sleeve, including, an elastic insulating layer on an outer circumference of the fixing assist roller and a first low-resistivity layer under the elastic insulating layer and having a volume resistivity not greater than $5.0\times10^{-8}$ ·m, wherein an outer surface of the elastic insulating layer includes alternating convexities and concavities along a circumferential direction thereof.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
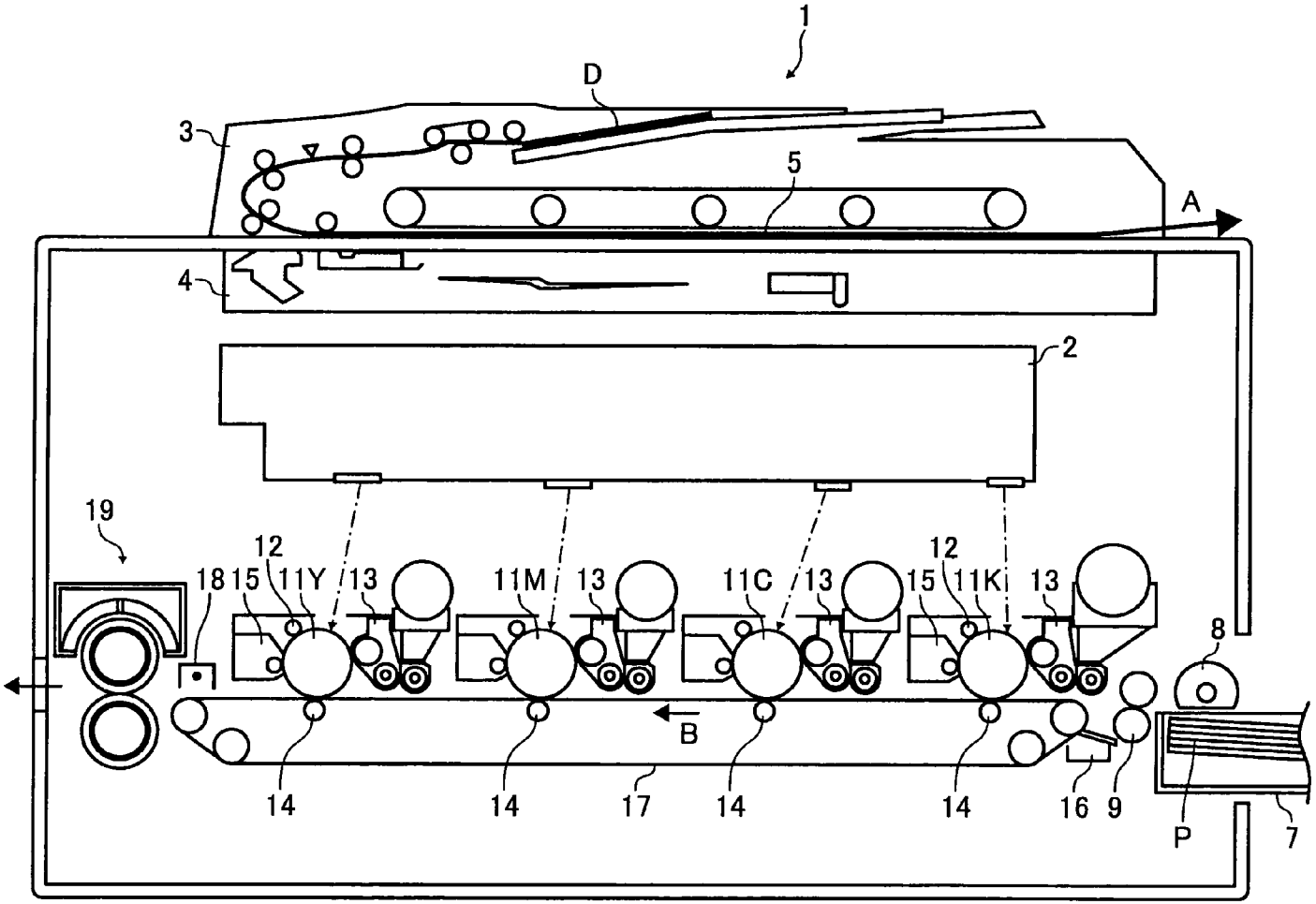
FIG. 1 is an illustration of an image forming apparatus according to an example embodiment of the present invention.

It will be understood that if an element or layer is referred to as being "on," "against," "connected to" or "coupled to" another element or layer, then it can be directly on, against, connected, or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

It is to be understood that each specific element includes all technical equivalents that operate in a similar manner. Referring now to the drawings, wherein like reference numerals designate identical or corresponding parts throughout the several views, particularly to FIG. 1, an image forming apparatus 1 that is a tandem color image forming apparatus according to an example embodiments is described.

As illustrated in FIG. 1, the image forming apparatus 1 may include a writing part 2, a document transporter 3 having a document table, a reading part 4, a sheet feeder 7, a transport roller 8, and a pair of registration rollers 9. The writing part 2 may include a polygon mirror and four light sources corresponding to yellow, magenta, cyan, and black. The document transporter 3 and the reading part 4 are provided in an upper part of the image forming apparatus 1. The reading part 4 may include a contact glass 5, an irradiating lamp, mirrors, a lens, and a color sensor. The writing part 2 may be provided below the reading part 4. The sheet feeder 7 may be provided in a lower part of the image forming apparatus 1.

The document transporter 3 may transport an original document onto the contact glass 5. The reading part 4 may optically read image information on the original document. The writing part 2 may emit a laser light based on the image information. The sheet feeder 7 stores recording mediums. The pair of registration rollers 9 may adjust a timing to send a sheet of recording mediums.

The image forming apparatus 1 may further include photoconductor drums 11Y, 11M, 11C, and 11K on which electrostatic latent images of yellow, magenta, cyan, and black are respectively formed, chargers 12, developing units 13, transfer bias rollers 14, cleaners 15, a transfer belt cleaner 16, a transfer belt 17, a separation charge 18, and a fixer 19, below the writing part 2.

The letters Y, M, C, and K represent yellow, magenta, cyan, and black, respectively. For example, the writing part 2, one of the photoconductor drums 11Y, 11M, 11C, and 11K, one of the chargers 12, and one of the developing units 13 constitute an image forming mechanism to form a toner image.

Each of the chargers 12 charges one of the photoconductor drums 11Y, 11M, 11C, and 11K. Each of the developing units 13 develops one of the electrostatic latent images into a toner image. Each of the transfer bias rollers 14 transfers the toner image onto a sheet P. The cleaners 15 may remove toner from the photoconductor drums 11Y, 11M, 11C, and 11K that is not transferred onto the sheet P.

The transfer belt 17 may move in a direction of arrow B to transport the sheet P. The cleaner 16 cleans the transfer belt 17. The fixer 19 is an electromagnetic induction heating fixer and fixes the toner image (unfixed image) on the sheet P. The image forming apparatus 1 further includes an image processor to process image signals.

Next, a standard procedure to form a color image by the image forming apparatus 1 is described. The document transporter 3 transports an original document D in a direction shown by arrow A from the document table to the contact glass 5.

The reading part 4 scans the original document D while applying light from the irradiator thereto. The reading part 4 focuses the light reflected by the original document D on the color sensor via the mirrors and the lens. The reading part 4 further reads the image information with the color sensor for each color separation light of red, green, and blue (RGB), and then converts the image information into electronic image signals. The image processor may convert colors and may correct the colors, spatial frequency, etc., based on the color separation image signals. Thus, the image processor may obtain image information of yellow, magenta, cyan, and black.

The image processor may transmit the image information of yellow, magenta, cyan, and black to the writing part 2. The writing part 2 applies laser lights (exposure lights) based on image information of the respective colors to the photoconductor drums 11Y, 11M, 11C, and 11K.

While the photoconductor drums 11Y, 11M, 11C, and 11K rotate clockwise in FIG. 1, the surfaces thereof are uniformly charged at areas facing the chargers 12, respectively, in a charging process. Thus, the chargers 12 form charge potentials on photoconductor drums 11Y, 11M, 11C, and 11K, respectively. After the charging process, the charged area of each of the photoconductor drums 11Y, 11M, 11C, and 11K reaches a position to receive the laser light from the writing part 2.

The writing part 2 emits laser lights corresponding to the image signals from the four light sources in an exposure process. The laser lights pass through different light paths for color components of yellow, magenta, cyan, and black, respectively.

The laser light corresponding to the yellow component reaches the surface of the photoconductor drum 11Y that is the first from the left in FIG. 1. In this process, the laser light corresponding to the yellow component is applied to the photoconductor drum 11Y in a rotation shaft direction thereof (main scanning direction) with the polygon mirror. As a result, an electrostatic latent image corresponding to the yellow component is formed on the surface of the photoconductor drum 11Y that is charged by the charger 12.

Similarly, the laser light corresponding to the magenta component reaches the surface of the photoconductor drum 11M that is the second from the left in FIG. 1 and an electrostatic latent image corresponding to the magenta component is formed. The laser light corresponding to the cyan component reaches the surface of the photoconductor drum 11C that is the third from the left in FIG. 1 and an electrostatic latent image corresponding to the cyan component is formed. The laser light corresponding to the black component reaches the surface of the photoconductor drum 11K that is the fourth from the left in FIG. 1 and an electrostatic latent image corresponding to the black component is formed.

Each of the surface regions of the photoconductor drums 11Y, 11M, 11C, and 11K in which the electrostatic latent images are respectively formed reaches a point facing one of the developing unit 13. The developing units 13 apply toner of respective colors to the surfaces of the photoconductor drums 11Y, 11M, 11C, and 11K in a developing process. Thus, the electrostatic latent images are developed into toner images.

Next, processes to transport the sheet P are described. The transport roller 8 may send out a sheet P from the sheet feeder 7. The sheet P is transported along a transport guide (not shown) to the pair of registration rollers 9. The registration rollers 9 send the sheet P timely to the transfer belt 17.

After the developing process, each of the surface regions of the photoconductor drums 11Y, 11M, 11C, and 11K on which the toner image are formed reaches a position facing the transfer belt 17.

The transfer belt 17 may transport the sheet P in the direction of arrow B. Each of the transfer bias rollers 14 is placed at the position facing one of the photoconductor drums 11Y, 11M, 11C, and 11K via the transfer belt 17. The toner images are transferred from the photoconductor drums 11Y, 11M, 11C, and 11K onto the sheet P on the transfer belt 17 at the positions facing the transfer bias rollers 14 in a transfer process. The different color toner images are superposed one on top of the other and a color image is formed on the sheet P.

After the transfer process, each of the surface region of the photoconductor drums 11Y, 11M, 11C, and 11K reaches a point facing one of the cleaners 15. The cleaners 15 collect toner remaining on the photoconductor drums 11Y, 11M, 11C, and 11K in a cleaning process. Next, the surfaces of the photoconductor drums 11Y, 11m, 11C, and 11K pass discharge regions (not shown), respectively. Thus, image forming procedure is completed.

The sheet P on which the color image is formed is transported to a position facing the separation charger 18. The separation charger 18 neutralizes electric charge accumulated on the sheet P. Therefore, the sheet P may be separated from the transfer belt 17 while toner scattering is prevented. Next, the transfer belt cleaner 16 may collect the toner, etc., adhered on the transfer belt 17.

After being separated from the transfer belt 17, the sheet P reaches the fixer 19 where the color image (toner) is fixed on the sheet P in a fixing process. After the fixing process, an ejection roller (not shown) may eject the sheet P from the image forming apparatus 1 as an output sheet. Thus, an image recording procedure is completed.

Figure 2:
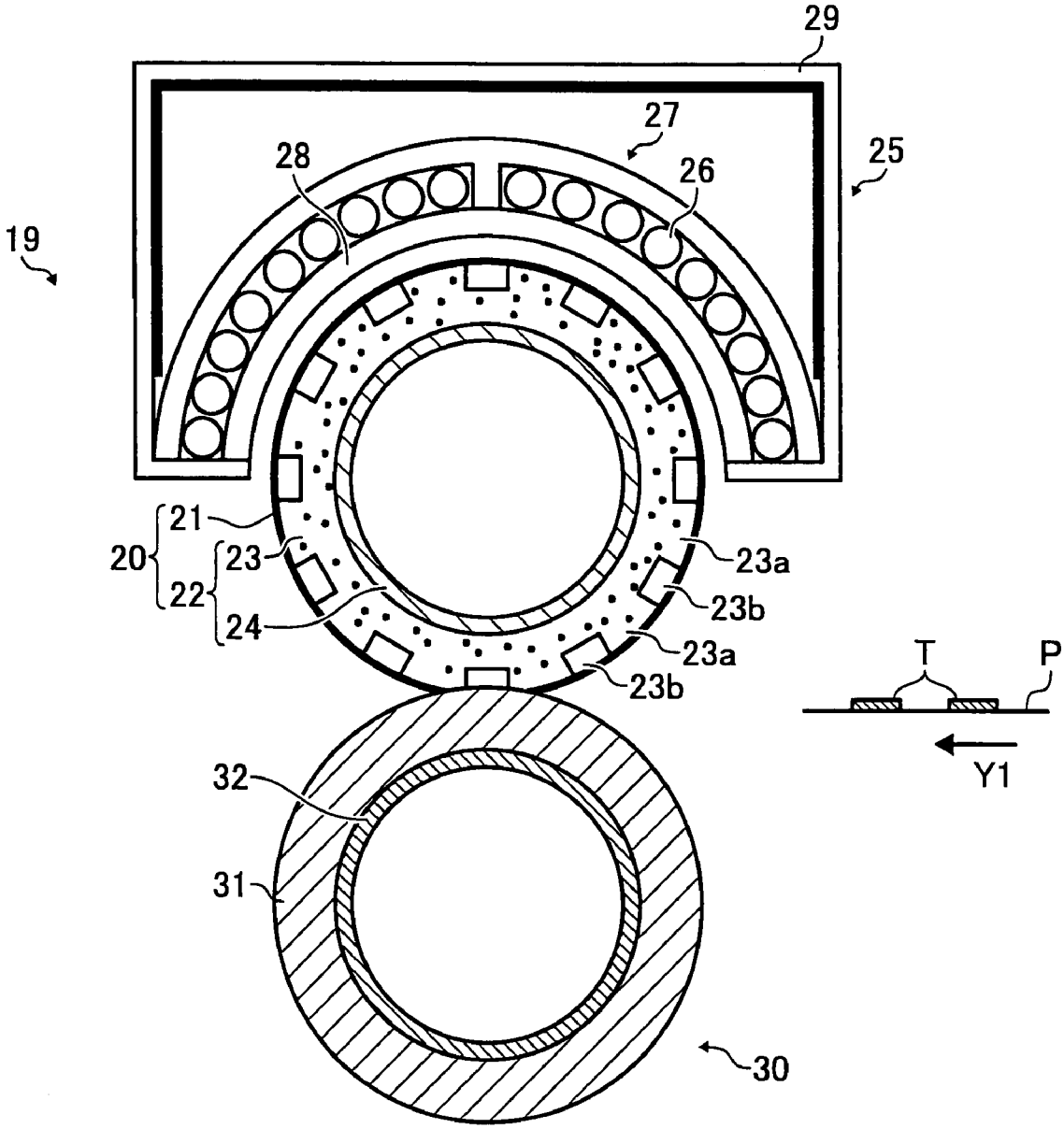
FIG. 2 is an example cross-section diagram of a fixer included in the image forming apparatus of FIG. 1.

Next, example embodiments of the fixer 19 are described in detail, referring to FIG. 2. The fixer 19 may include a fixing roller 20; an induction heater 25 that is a flux generator and faces a part of the fixing roller 20; and/or a pressuring roller 30 as a pressurizer. The pressing roller 30 presses the fixing roller 20 and forms a fixing nip with the fixing roller 20. The sheet P having toner images T is transported in a direction of arrow Y1 in FIG. 2 and passes through the fixing nip, guided by a guide plate (not shown).

The fixing roller 20 may include a fixing sleeve 21 and a fixing assist roller 22. The fixing assist roller 22 may include an elastic insulating layer 23 and a core metal 24 that is a first low-resistivity layer. The elastic insulating layer 23 has elasticity and heat resistance, and covers the core metal 24. The core metal 24 may be formed of a conductor having a volume resistivity of less than $5.0\times10^{-8}$ Ωm (e.g., aluminum, copper, etc).

The elastic insulating layer 23 may include an elastic foamed material (e.g., foamed silicone rubber) or an elastic material (silicone rubber). The elastic insulating layer 23 may include convexities 23*a* and concavities 23*b* that are alternately formed on the outer surface thereof continuously along a circumferential direction thereof. Because concavities 23*b* are formed on the outer circumference of the elastic insulating layer 23, the contact area of the fixing sleeve 21 and the elastic insulating layer 23 is decreased from the case where the outer circumference of the elastic insulating layer is not a concave-convex surface.

The induction heater 25 may include a coil 26, a core part 27, a coil guide 28, and/or a cover 29. The coil 26 may be formed of a litz wire in which thin wires are twisted together. The coil guide 28 faces the fixing roller 20 to cover a part of the fixing roller 21 in a noncontact manner. The coil 26 is coiled on the coil guide 28 and may be provided in a width direction of the fixing roller 20 (vertical direction in FIG. 2 from paper surface). The coil guide 28 holds the coil 26 and may include a resin having a relatively high heat resistivity.

The core part 27 may be provided to face the coil 26 that extends in the width direction, from an opposite side of the coil guide 28. The core part 27 includes a ferromagnetic material (e.g., ferrite) that has a relative magnetic permeability of about 2500. The core part 27 may include a center core and a side core to form an efficient magnetic flux toward the fixing sleeve 21. The cover 29 is configured to cover the coil 26, the core part 27, and the coil guide 28.

The pressing roller 30 may include a cylinder 32, an elastic layer 31 covering the cylinder 32, and a release layer (not shown). Example materials of the cylinder 32 include aluminum, copper, etc. Example materials of the elastic layer 31 include silicone rubber, etc. An example material of the release layer is PFA. The elastic layer 31 may have a layer thickness within a range from 1 mm to 5 mm. The release layer may have a layer thickness within a range from 20 μm to 50 μm.

The fixing assist roller 22 is inserted inside the fixing sleeve 21 in an example embodiment. Alternatively, the fixing assist roller 22 and the fixing sleeve 21 may be bonded together as a unit. Alternatively, the fixing assist roller 22 and the fixing sleeve 21 may be formed as separate units. In example embodiments, a regulator may be provided for preventing the fixing sleeve 21 from shifting in a thrust direction when the fixing assist roller 22 and the fixing sleeve 21 are separate units.

The fixer 19 further includes a thermistor (not shown) contacting the surface of the fixing sleeve 21 and a power source (now shown) for sending an electric current to the coil 26. The thermistor is a thermosensor having a high thermal responsiveness and senses the temperature of the surface of the fixing sleeve 21 that is the fixing temperature. The heating level by the induction heater 25 is adjusted based on the sensing by the thermistor.

Figure 3:
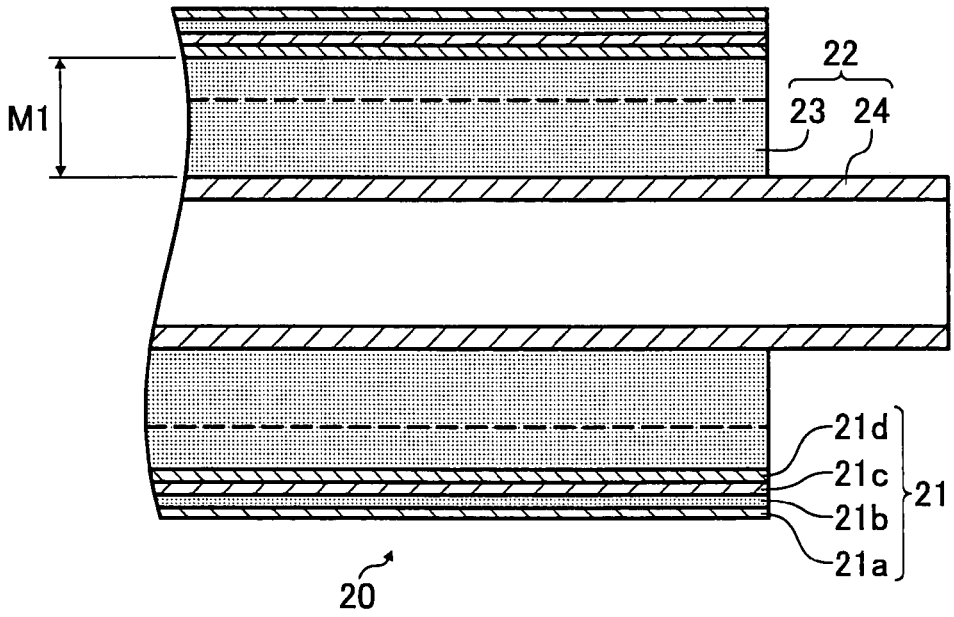
FIG. 3 is an example cross-section diagram of a fixing roller included in the fixer of FIG. 2.

Referring to FIG. 3, the fixing roller 20 is further described. The fixing sleeve 21 has a multi-layer construction and may include a heating layer 21*d* as a first heating layer, a second heating layer 21*c*, an elastic layer 21*b*, and a release layer 21*a* from inside. In FIG. 3, M1 represents a distance (gap) between the heating layer 21*d* and the core metal 24.

The heating layer 21*d* has a predetermined or desirable Curie point. Because of the Curie point, the heating layer 21*d* is capable of autogenous temperature control. The heating layer 21*d* may be formed of a magnetic conductive material. Examples of the magnetic conductive material include nickel, iron, chrome, cobalt, copper, and alloys of the above metals. In an example embodiment, the heating layer 21*d* has a layer thickness of about 50 μm and is formed of a degaussing alloy having a Curie point within a range from a toner fixable temperature to 300° C. For example, the degaussing alloy is an alloy of nickel, iron, and chrome. The alloy is adjusted to have a Curie point of about 250° C. by adjusting blend ratios of respective materials and processing conditions. The fixing roller 20 may maintain autogenous temperature control by including the degaussing alloy as the heating layer 21*d*.

The second heating layer 21*c* may have a volume resistivity lower than the volume resistivity of the heating layer 21*d* and may include a relatively high conductive material (e.g., copper, silver, and aluminum). As an example embodiment, the second heating layer 21*c* has a layer thickness of about 15 μm and a volume resistivity not greater than $5.0\times10^{-8}$ Ωcm. When the second heating layer 21*c* is a copper layer, the copper layer may be formed on the heating layer 21*d* (degaussing alloy layer) through a plating process. Because the fixing sleeve 21 includes the second heating layer 21*c* having a lower resistivity in addition to the hating layer 21*d* that is the degaussing alloy layer, the fixing sleeve 21 (the heating layer 21*d* and the second heating layer 21*c*) may be efficiently heated by the magnetic flux generated by the induction heater 25 even before the heating layer 21*d* is heated to its Curie point.

The elastic layer 21*b* has a layer thickness of about 200 μm and may include silicone rubber, etc. Unevenness in fixing, especially in color image forming, may be reduced or prevented by including the elastic layer 21*b* in the fixing sleeve 21.

The releasing layer 21*a* has a layer thickness of about 30 μm and may include a fluorine compound, for example, PFA. Because a toner image directly contacts the surface of the fixing sleeve 21, the release layer 21*a* is formed to enhance the releasability of toner therefrom. A tube material may be used as the releasing layer 21*a*.

The configuration of the fixing sleeve 21 is not limited to the above example. For example, the fixing sleeve 21 may further include a nickel layer, etc., to improve the corrosion resistivity of the second heating layer 21*c*. Although the first low-resistivity layer (core metal 24) is formed directly under the elastic insulating layer 23 in an example embodiment, another layer may be formed between the elastic insulating layer 23 and the first low-resistivity layer.

The autogenous temperature control of the fixing roller 20 may be enhanced by providing the core metal 24 (first low-resistivity layer) having the volume resistivity of less than $5.0\times10^{-8}$ Ωm under the heating layer 21*d* (via the elastic insulating layer 23). That is, when the temperature of the heating layer 21*d* reaches its Curie point, the heating layer 21*d* loses magnetism and the magnetic flux penetrates the heating layer 21*d* and reaches the core metal 24. In the core metal 24, an eddy-current is generated in a direction that may negate the magnetic flux. Accordingly, the eddy-current load in the heating layer 21*d* is decreased and input power is decreased. Thus, heat generating is decreased.

The eddy-current load is described below. The eddy-current load is expressed by $$d=\rho/\delta$$

where d is the eddy-current load, ρ is a volume resistivity (Ωm) of a heating layer, and δ is a penetration depth (m) of the heating layer (epidermis depth).

However, when the layer thickness of the heating layer is not greater than the penetration depth δ, the eddy-current load d is expressed by $$d=\rho/t$$

where t is the layer thickness of the heating layer.

Here, the penetration depth δ is obtained by $$\delta=503\cdot[\rho/(\mu f)]^{1/2}$$

where μ is a relative magnetic permeability of the heating layer and f is a frequency (Hz) of the alternating current applied to a coil for inductively heating the heating layer.

Figure 4:
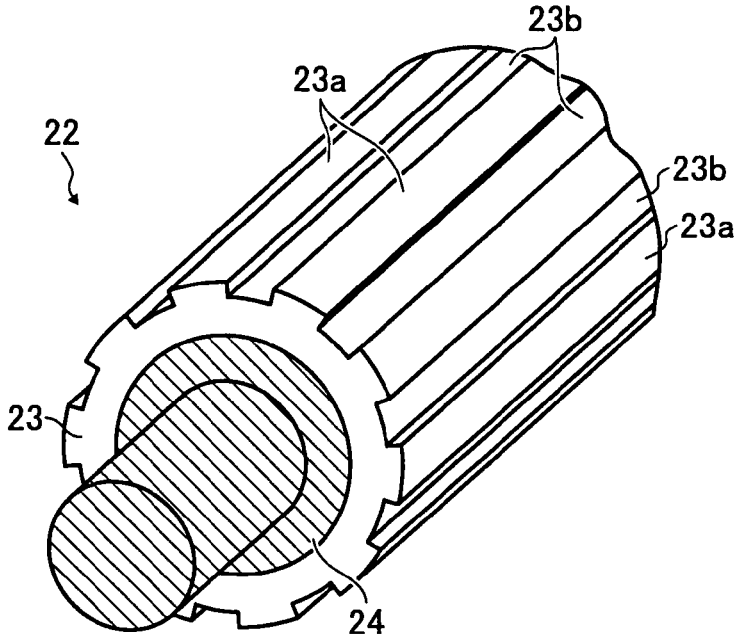
FIG. 4 is an example illustration of a fixing assist roller included in the fixing roller of FIG. 3.

Referring to FIG. 4, the elastic insulating layer 23 of the fixing assist roller 22 is further explained. The elastic insulating layer 23 is for providing a sufficient fixing nip and for reducing the amount of heat loss from the fixing sleeve 21 to the fixing assist roller 22. For example, the convexities 23*a* and the concavities 23*b* are alternately formed in the width direction of the fixing assist roller 22 along the outer circumference of the elastic insulating layer 23.

Because the concavities 23*b* are formed on the outer circumference of the elastic insulating layer 23 like slots in the width direction, the elastic insulating layer 23 may be easily dented by the pressure of the pressing roller 30, even when the elastic insulating layer 23 is relatively thin. Therefore, a sufficient fixing nip may be formed.

Figure 5A:
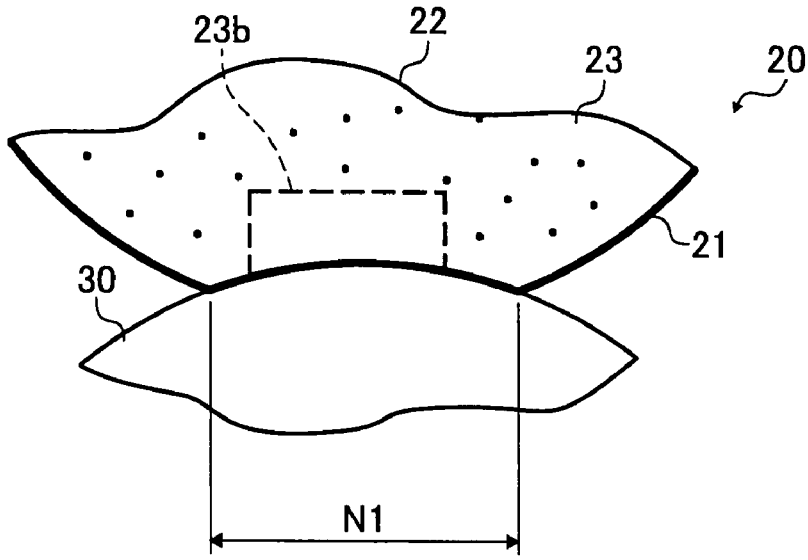
FIG. 5A illustrates an example fixing nip formed in the fixer of FIG. 2.
Figure 5B:
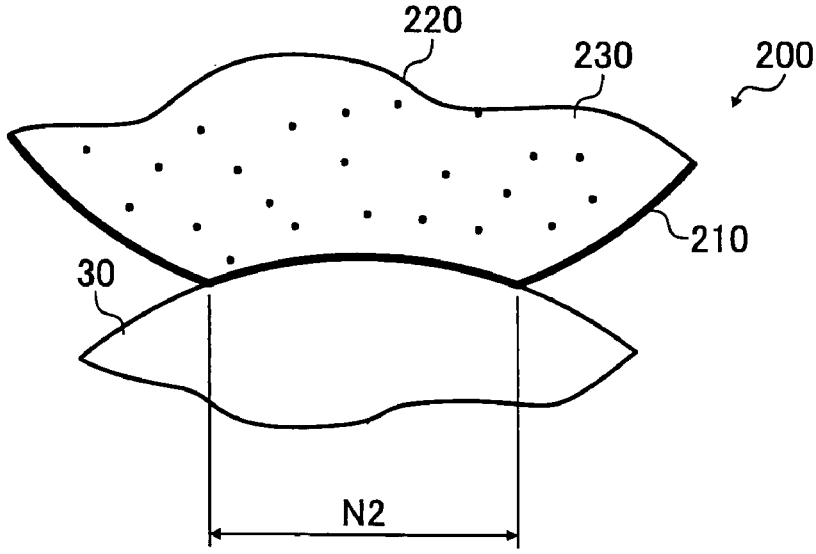
FIG. 5B illustrates an example fixing nip formed in a fixer according to a comparative example.

FIG. 5A illustrates a fixing nip N1 formed between the pressing roller 30 and the fixing sleeve 21 of the fixing roller 20. FIG. 5B illustrates a fixing nip N2 formed between the pressing roller 30 and a fixing roller 200 as a comparison example. The fixing roller 200 includes a fixing sleeve 210 and a fixing assist roller 220 inside the fixing sleeve 210. The fixing assist roller 220 includes an elastic insulating layer 230. The outer circumference of the elastic insulating layer 230 is not a concave-convex surface. In other respects, the fixing roller 200 has a similar configuration to the fixing roller 20 of FIGS. 2 to 4. The fixing nip N2 is smaller than the fixing nip N1. Because the outer circumference of the elastic insulating layer 230 is not a concave-convex surface, the elastic insulating layer 230 is less dented when the elastic insulating layer 230 is relatively thin.

As described above, the contact area of the fixing sleeve 21 and the elastic insulating layer 23 is decreased because of the convexities 23*a* and the concavities 23*b*. Therefore, less heat is transmitted from the fixing sleeve 21 to the fixing assist roller 22 than the case where the outer circumference of the elastic insulating layer is not a concave-convex surface. Thus, the efficiency in the temperature rising of whole the fixing roller 20 may be improved.

Next, functions of the fixing roller 19 are described. A driving motor (not shown) drives the fixing roller 20 to rotate clockwise in FIG. 2, which causes the pressing roller 30 to rotate counterclockwise in FIG. 2. The outer surface of the fixing sleeve 21 is heated at a position facing the induction heater 25 by the magnetic flux generated by the induction heater 25.

The power source includes a frequency-tunable oscillating circuit and sends a high-frequency alternating current within a range from 10 kHz to 1 MHz. An example range of the high-frequency alternating current is from 20 kHz to 800 kHz.

Figure 6A:
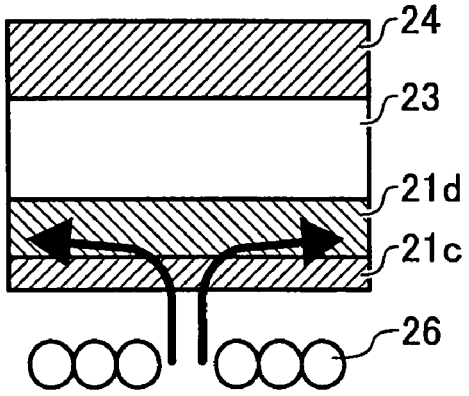
FIGS. 6A and 6B are example illustrations to explain a magnetic flux acting on the fixing roller.
Figure 6B:
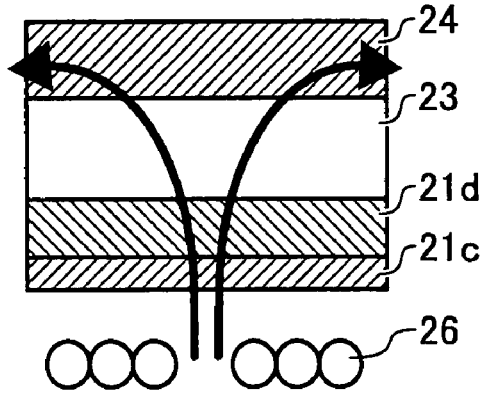

FIGS. 6A and 6B illustrate a part of fixing roller 20. The release layer 21*a* and the elastic layer 21*b* are omitted in FIGS. 6A and 6B.

Referring to FIG. 6A, when the temperature of the heating layer 21*d* is under the Curie point and the power source applies high-frequency alternating current to the coil 26, magnetic force lines are formed from the coil 26 toward the heating layer 21*d* and the second heating layer 21*c*. The magnetic force lines switch the direction alternately. When an alternating magnetic field is formed as above, eddy-currents are generated in the heating layer 21*d* and the second heating layer 21*c*. Due to the electric resistance thereof, the heating layer 21*d* and the second heating layer 21*c* are heated by joule heating. Thus, the fixing sleeve 21 (fixing roller 20) is heated by the induction heating of the heating layer 21*d* and the second heating layer 21*c*.

The heated portion of the surface of the fixing sleeve 21 (fixing roller 20) reaches the contact area with the pressing roller 30 (fixing position) in FIG. 2. At the fixing position, the toner image T (toner) is fused and fixed on the sheet P with the heat from the fixing roller 20 and the pressure from the pressing roller 30. The sheet P is sent out from the fixing nip.

The portion of the surface of the fixing roller 20 passes the fixing position and then reaches again the position facing the induction heater 25 in FIG. 2. The above sequence is continuously repeated and the fixing process is completed.

Referring to FIG. 6B, when the temperature of the heating layer 21*d* reaches the Curie point thereof and the heating layer 21*d* loses magnetism, the magnetic force lines are formed from the coil 26 toward the core metal 24 penetrating the heating layer 21*d* and the second heating layer 21*c*. An eddy current is generated in the core metal 24 (first low-resistivity layer) in a direction that may negate the magnetic flux. An eddy-current load in the heating layer 21*d* is decreased and input power is decreased. As a result, an amount of heat generation is decreased. Thus, the heating layer 21*d* is capable of autogenous temperature control because of the Curie point.

Therefore, even where sheets having smaller widths are continuously fixed or the fixer 19 is accidentally stopped, excessive temperature rising of the fixing roller 20 may be prevented. Therefore, fixing failures such as hot offset and cold offset may be reduced or prevented.

As described above, an example embodiment includes characteristics that the heating layer 21*d* includes a material having a predetermined or a desirable Curie point; the first low-resistivity layer (core metal 24) is provide under the elastic insulating layer 23 in the fixing assist roller 22; and the convexities and the concavities are alternately formed on the outer circumference surface of the elastic insulating layer along the circumference direction. Therefore, a sufficient fixing nip may be formed and the warm-up time of fixing roller 20 (fixer 19) may be shortened. Further, excessive heating of the fixing roller 20 may be reduced or prevented even where images on small-sized sheets are continuously fixed or the fixer 19 is accidentally stopped.

Figure 7:
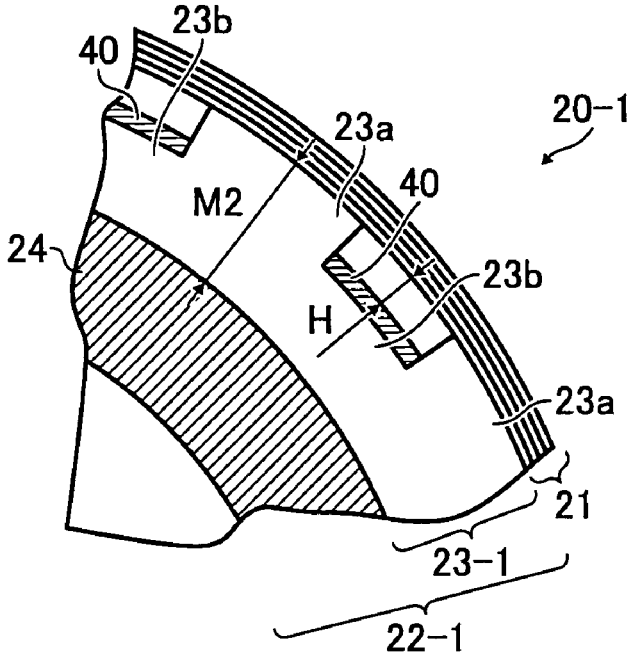
FIG. 7 is an example illustration of a fixing assist roller.

Next, a fixing roller 20-1 according to an example embodiment is described. As illustrated in FIG. 7, the fixing roller 20-1 includes a fixing sleeve 21 and a fixing assist roller 22-1 inside the fixing sleeve 21.

The fixing assist roller 22-1 may include an elastic insulation layer 23-1 having convexities 23*a* and concavities 23*b* alternately formed on the outer circumference thereof and a core metal 24 that is a first low-resistivity layer, similarly to the fixing assist roller 22 of FIG. 4. Further, a second low-resistivity layer 40 is formed on each of the concavities 23*b*.

In other respects, the fixing roller 20-1 has a similar configuration to the configuration of the fixing roller 20 of FIGS. 2 and 3.

The second low-resistivity layer 40 has a volume resistivity of $5.0\times10^{-8}$ Ωm or less. The layer thickness of the second low-resistivity; layer 40 is set to 100 μm. In an example embodiment, the second low-resistivity layer 40 is formed with aluminum and has a layer thickness of about 100 μm. Aluminum thin films are relatively easily formed. A distance between the core metal 24 and the fixing sleeve 21 is referred to as a distance M2. A distance between the second low-resistivity layer 40 and the fixing sleeve 21 (heating layer 21*d*) is referred to as a gap H and is set to 2 mm.

As described above, the assist roller 22-1 includes the second low-resistivity layer 40 formed on each of the concavities 23*b* as another low-resistivity layer in addition to the core metal 24. Further, each of the second resistivity-layer 40 faces the fixing sleeve 21 from an adjacent position therefrom. Therefore, the autogenous temperature control of the fixing roller 20 may be further increased.

The second low-resistivity layer 40 may have a layer thickness within a range from 50 μm to 150 μm. If the second low-resistivity layer 40 is thinner than 50 μm, the second low-resistivity layer 40 may generate an excessive heating value. However, the heat generated by the second low-resistivity layer 40 does not cause a significant problem because the second low-resistivity layer 40 is not in contact with the fixing sleeve 21.

If the second low-resistivity layer 40 is thicker than 150 μm, the dent of the elastic insulating layer 23D may be negatively affected and a sufficient fixing nip may not be obtained.

Next, a relation between the thickness of the elastic insulating layer 23 and autogenous temperature control of the fixing roller 20 is explained. The thickness of the elastic insulating layer 23 is equal to the distance M1 (FIG. 3) between the heating layer 21*d* (degaussing alloy layer) and the core metal 24 (first low-resistivity layer). If the elastic insulating layer 23 is excessively thick, the autogenous temperature control is decreased, although a sufficient fixing nip is formed. To the contrary, if the thickness of the elastic insulating layer 23 is excessively thin, a sufficient fixing nip may not be formed, although the autogenous temperature control is increased.

Figure 8:
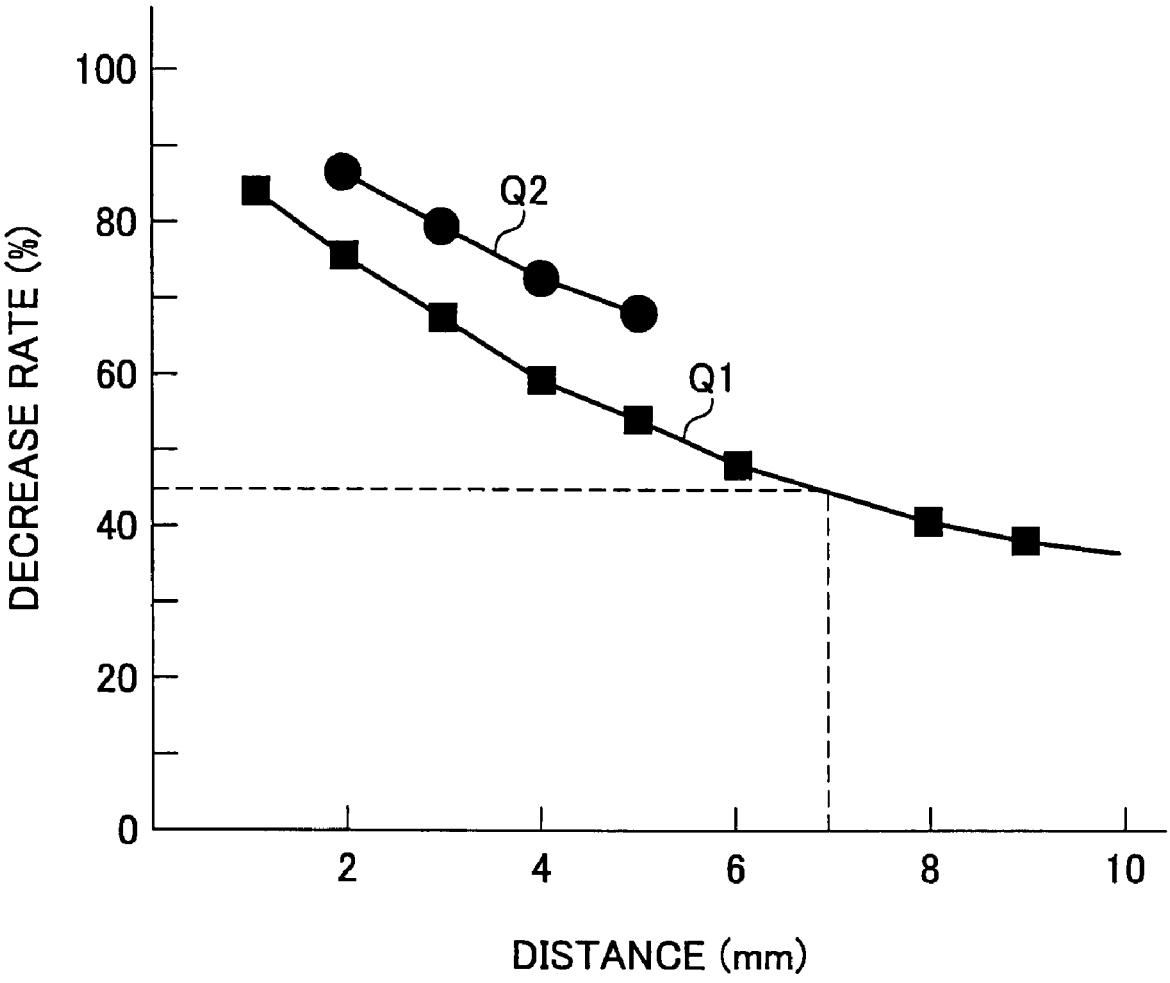
FIG. 8 is an example graph showing a relation between a heating decrease rate of the fixing roller and a distance between a heating layer and a core metal.

FIG. 8 is a graph showing the relation between a heating decrease rate of the fixing roller 20 and a distance M1 between the heating layer 21*d* and the core metal 24. In the graph, Q1 is the heating decrease rate when the fixing assist roller 22 of FIG. 3 is used and Q2 is the heating decrease rate when the fixing assist roller 22-1 is used.

The heating decrease rate is, in other words, a heating inhibition rate that is an indicator of the autogenous temperature control.

The heating decrease rate W is expressed by $$W=|(W2-W1)/W1|$$

where W1 is a heat value generated before the temperature of the heating layer 24*d* reaches the Curie point, and W2 is a heat value generated after the temperature of the heating layer 24 reaches the Curie point.

As a result of experiments, it was determined that the excessive temperature rising of the fixing roller 20 was prevented when the heating decrease rate W is not less than 45%. Therefore, to provide a sufficient autogenous temperature control, the distance M between the heating layer 21*d* and the core metal 24 (first low-resistivity layer) should be 7 mm or less. In the fixing roller 20 of FIG. 2, the distance M1 is 5 mm. Because the convexities 23*a* and the concavities 23*b* are formed on the elastic insulation layer 23, a sufficient fixing nip is available even if the thickness of the elastic insulating layer 23 is relatively thin. Even when the fixer 19 is configured to operate at an increased speed, an efficient fixing property may be obtained.

As shown in FIG. 8, the heating decrease rate Q2 of the fixing assist roller 22-1 is higher than the heating decrease rate Q1 of the fixing assist roller 22.

Figure 9:
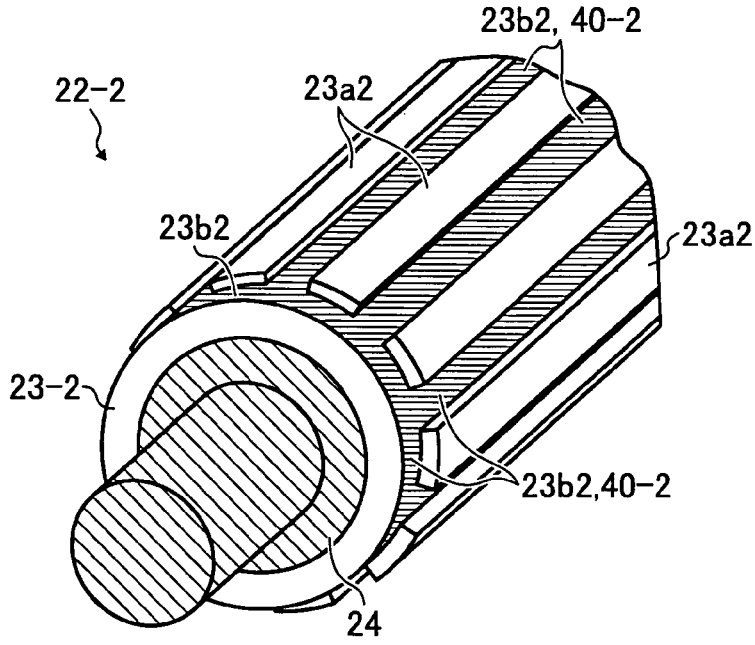
FIG. 9 is an example illustration of a fixing assist roller.
Figure 10:
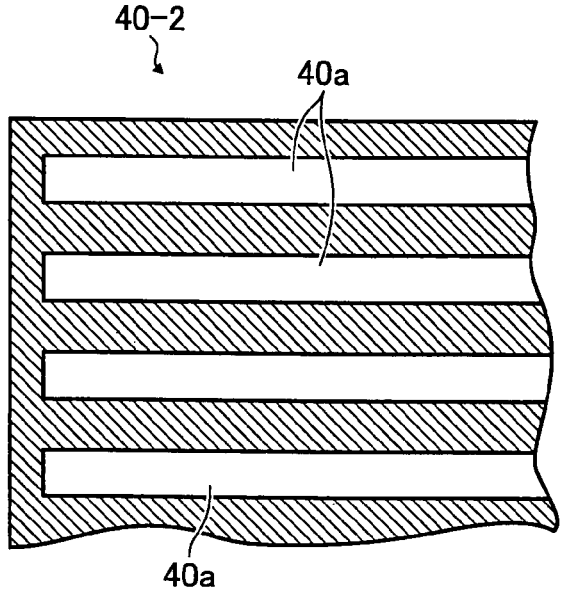
FIG. 10 is an example illustration of a second low-resistivity layer included in the fixing assist roller of FIG. 9.

Next, a fixing assist roller 22-2 according to an example embodiment is described, referring to FIGS. 9 and 10.

As illustrated in FIG. 9, the fixing assist roller 22-2 may include an elastic insulation layer 23-2 and a core metal 24 that is a first low-resistivity layer, similarly to the fixing assist roller 22 of FIG. 4. Further, convexities 23*a*2 and a concavities 23*b*2 are provided on the outer circumference of the elastic insulation layer 23-2. In a center part of the fixing assist roller 22-2, a plurality of concavities 23*b*2 are formed in the width direction thereof. The entire circumferences of both ends of the fixing assist roller 22-2 are formed of concavities 23*b*2. For example, the concavities 23*b*2 form a single plane on the entire circumference of each end of the fixing assist roller 22-2. The plurality of concavities 23*b*2 in the center part may be connected to the concavities 23*b*2 in both ends of the fixing assist roller 22-2 to form a continuous concave surface. A second low-resistivity layer 40-2 is continuously formed on the concavities 23*b*2 and united thereto.

For example, in a center region of the elastic insulating layer 23-2 in the width direction thereof, the plurality of convexities 23*a*2 and a plurality of concavities 23*b*2 are alternately and continuously formed in stripes along the circumference direction. In other respects, the fixing assist roller 22-2 has a similar configuration to the fixing assist roller 22-1.

FIG. 10 illustrates the second low-resistivity layer 40-2 before being provided on the elastic insulating layer 23-2. The second low-resistivity layer 40-2 may be a thin aluminum film having a plurality of holes or slots 40*a*. The holes or slots 40*a* are located positions corresponding to the positions of the convexities 23*a*2.

To assemble the fixing assist roller 22-2, the convexities 23*a*2 are fitted into the holes or slots 40*a* and the second low-resistivity layer 40-2 is bonded to the elastic insulating layer 23-2.

Because the second low-resistivity layer 40-2 is provided on the elastic insulating layer 23-2 as described above, an assembling accuracy of the fixing assist roller 22-2 may be enhanced. Further, the bonded area of the second low-resistivity layer 40-2 is increased, which may reduce or prevent exfoliation of the second low-resistivity layer 40-2.

Further, the eddy-currents on the second low-resistivity layer 40-2 may more easily flow when the temperature of the heating layer 21*d* of the fixing sleeve 21 (FIG. 3) exceeds the Curie point because the both ends of the elastic insulating layer 23-2 are formed of the continuous concavities 23*b*2. Therefore, the autogenous temperature control of the fixing roller 20 may be further enhanced. Here, the eddy-currents flow in a direction opposite to the flowing direction of the current to the coil 26. The flowing direction of the eddy-currents is perpendicular to the magnetic flux generated by the coil 26.

Figure 11:
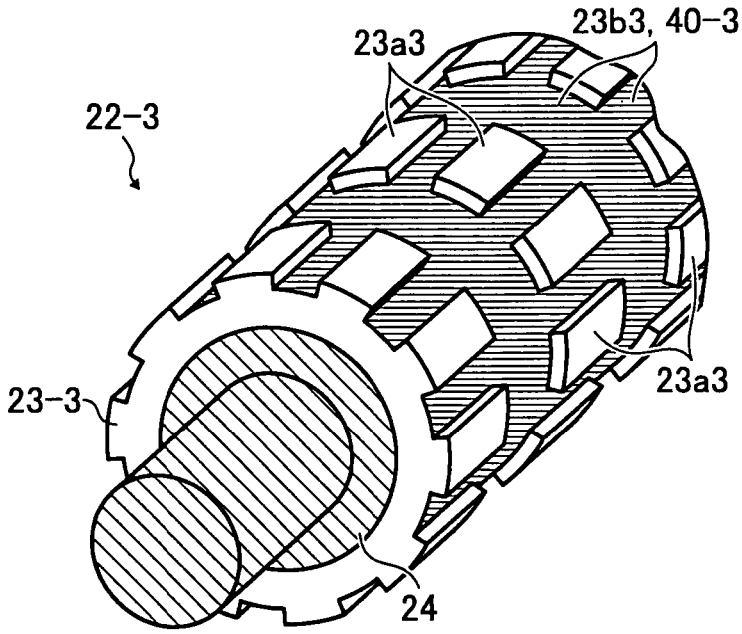
FIG. 11 is an example illustration of a fixing assist roller.
Figure 12:
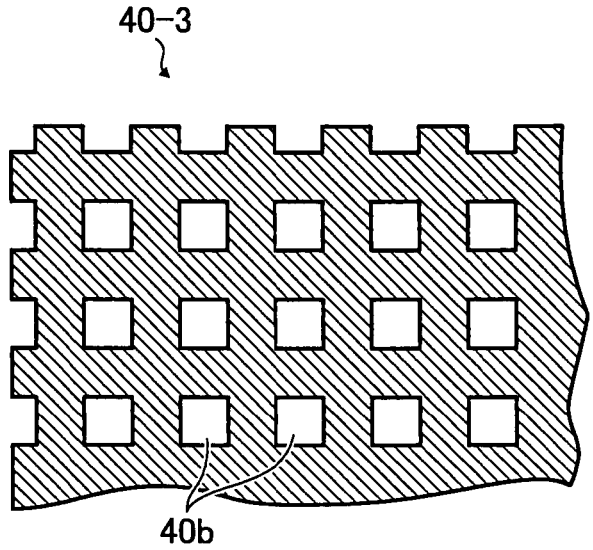
FIG. 12 is an example illustration of a second low-resistivity layer included in the fixing assist roller of FIG. 11.

Referring to FIGS. 11 and 12, a fixing assist roller 22-3 according to an example embodiment is described. The fixing assist roller 22-3 may include an elastic insulation layer 23-3 having convexities 23*a*3 and concavities 23*b*3; and a core metal 24 that is a first low-resistivity layer, similar to the fixing assist roller 22-2 of FIG. 9. Further, a second low-resistivity layer 40-3 is continuously provided on the concavities 23*b*3. The concavities 23*b*3 are formed in both of the width direction and the circumference direction of the fixing assist roller 22-3. All of concavities 23*b*3 in the width direction and the circumference direction may be connected together. The concavities 23*b*3 may be formed in a shape of a lattice, unlike the concavity 23*b*2 of FIG. 10. In other respects, the fixing assist roller 22-3 has a similar configuration to the fixing assist roller 22-2.

Because the concavity 23*b*3 has a lattice shape, the convexities 23*a*3 and the concavities 23*b*3 are alternately located in the width direction of the elastic insulating layer 23-3, in addition to in the circumference direction thereof. For example, in a several regions of the elastic insulating layer 23-3, a whole circumference thereof is provided with concavities 23*b*3. For example, in such regions, whole the circumference of the elastic insulating layer 23-3 forms a single plane.

FIG. 12 illustrates the second low-resistivity layer 40-3 before being provided on the elastic insulating layer 23-3. The second low-resistivity layer 40-3 may be a thin aluminum film. For example, the second low-resistivity layer 40-3 is lattice-like shaped and has a plurality of holes 40*b* located positions corresponding to the positions of the convexities 23*a*3.

To assemble the fixing assist roller 22-3, the convexities 23*a*3 are fitted into the holes 40*b* and the second low-resistivity layer 40-3 is bonded to the elastic insulating layer 23-3. Therefore, an assembling accuracy of the fixing assist roller 22-3 may be enhanced and the bonded area of the second low-resistivity layer 40-3 is increased, which may reduce or prevent exfoliation of the second low-resistivity layer 40-3, similarly to the fixing assist roller 22-2 of FIG. 9.

Further, the second low-resistivity layer 40-3 provided on the elastic insulating layer 23-3 is more easily bended and/or deformed because the second low-resistivity layer 40-3 is lattice-like shaped. Therefore, the accuracy in assembling the fixing assist roller 22-3 may be further enhanced.

In example embodiments, a sufficient fixing nip may be formed and the warm-up time of a fixer may be shortened. Further, excessive heating of a fixing roller may be reduced or prevented even where images on small-sized sheets are continuously fixed or the fixer is accidentally stopped.

Having now fully described example embodiments, it will be apparent to one of ordinary skill in the art that many changes and modifications can be made thereto without departing from the spirit and scope of the invention as set forth therein. The quantity, position, and/or shape of each component are not limited to the quantity, position, shape described in example embodiments.

What is claimed is:

1. A fixing roller, comprising:

a fixing sleeve configured to fuse and fix a toner image on a recording medium, including, a first heating layer having a Curie point, configured to be heated with a magnetic flux;

a second heating layer provided outside of the first heating layer, the second heating layer having a volume resistivity lower than a volume resistivity of the first heating layer; and a fixing assist roller configured to be inserted into the fixing sleeve, including, an elastic insulating layer on an outer circumference of the fixing assist roller; and a first low-resistivity layer under the elastic insulating layer and having a volume resistivity not greater than $5.0\times10^{-8}$ Ωm.

2. The fixing roller according to claim 1, wherein an outer surface of the elastic insulating layer includes alternating convexities and concavities along a circumferential direction thereof.

3. The fixing roller according to claim 2, further comprising a second low-resistivity layer having a volume resistivity not greater than $5.0\times10^{-8}$ Ωm on each of the concavities.

4. The fixing roller according to claim 3, wherein the second low-resistivity layer has a layer thickness within a range from 50 μm to 150 μm.

5. The fixing roller according to claim 3, wherein the second low-resistivity layer comprises aluminum.

6. The fixing roller according to claim 2, wherein the concavities are in a shape of slots in the width direction on the elastic insulating layer.

7. The fixing roller according to claim 2, wherein the concavities are in a shape of a lattice on an entire circumference surface of the elastic insulating layer.

8. The fixing roller according to claim 1, wherein entire circumferences of both ends of the elastic insulating layer in width direction include concavities, and a second low-resistivity layer having a volume resistivity not greater than $5.0\times10^{-8}$ Ωm is formed on each of the concavities.

9. The fixing roller according to claim 1, wherein the elastic insulating layer comprises a plurality of regions whose entire circumferences include concavities, and wherein a second low-resistivity layer having a volume resistivity not greater than $5.0\times10^{-8}$ Ωm is formed on each of the concavities.

10. The fixing roller according to claim 1, wherein the first low-resistivity layer comprises aluminum.

11. The fixing roller according to claim 1, wherein the first low-resistivity layer is a core metal of the fixing assist roller.

12. The fixing roller according to claim 1, wherein the first heating layer comprises a degaussing alloy.

13. The fixing roller according to claim 1, wherein the second heating layer comprises copper.

14. A fixer, comprising:

the fixing roller of claim 1;

a pressurizer configured to pressurize the fixing roller; and a magnetic flux generator configured to generate a magnetic flux.

15. An image forming apparatus, comprising:

an image forming mechanism configured to form a toner image; and the fixer of claim 14.

* * * * *